US011143025B2

(12) United States Patent
Zhang et al.

(10) Patent No.: US 11,143,025 B2
(45) Date of Patent: Oct. 12, 2021

(54) MINE EXPLOITATION BASED ON STOPING, SEPARATION AND FILLING CONTROL

(71) Applicants: China University of Mining and Technology, Jiangsu (CN); Xuzhou Zhongkuang Backfilling & Mining Technology Co., Ltd., Jiangsu (CN)

(72) Inventors: Jixiong Zhang, Jiangsu (CN); Qiang Zhang, Jiangsu (CN); Zhongyu Wu, Jiangsu (CN); Feng Ju, Jiangsu (CN); Jiaqi Wang, Jiangsu (CN); Yang Chen, Jiangsu (CN)

(73) Assignees: China University of Mining and Technology, Jiangsu (CN); Xuzhou Zhongkuang Backfilling & Mining Technology Co. Ltd., Jiangsu (CN)

( * ) Notice: Subject to any disclaimer, the term of this patent is extended or adjusted under 35 U.S.C. 154(b) by 0 days.

(21) Appl. No.: 16/608,920

(22) PCT Filed: Apr. 1, 2019

(86) PCT No.: PCT/CN2019/080777

§ 371 (c)(1),
(2) Date: Oct. 28, 2019

(87) PCT Pub. No.: WO2020/062823

PCT Pub. Date: Apr. 2, 2020

(65) Prior Publication Data

US 2020/0408094 A1 Dec. 31, 2020

(30) Foreign Application Priority Data

Sep. 30, 2018 (CN) ..... 201811157747.7

(51) Int. Cl.
*E21F 15/00* (2006.01)
*E21C 41/18* (2006.01)
(Continued)

(52) U.S. Cl.
CPC ..... *E21C 41/18* (2013.01); *E21F 15/00* (2013.01); *E21C 39/00* (2013.01); *E21F 15/005* (2013.01); *E21F 15/06* (2013.01)

(58) Field of Classification Search
CPC ..... E21C 41/16; E21C 41/18; E21C 41/20; E21C 39/00; E21F 15/00; E21F 15/005; E21F 15/06; E21F 15/08
(Continued)

(56) References Cited

U.S. PATENT DOCUMENTS 4,465,401 A * 8/1984 Stoddord ..... E21B 33/138 299/11
4,778,219 A * 10/1988 Wilczynski ..... B03B 5/18 299/8
(Continued)

FOREIGN PATENT DOCUMENTS

CN 103899352 7/2014
CN 104373126 2/2015
(Continued)

OTHER PUBLICATIONS

English language machine translation of Yan et al., PCT Publication No. WO-2017101634-A1, published Jun. 22, 2017 (5 pages) (Year: 2017).*
(Continued)

*Primary Examiner* — Janine M Kreck
*Assistant Examiner* — Michael A Goodwin
(74) *Attorney, Agent, or Firm* — Lei Fang; Smith Tempel Blaha LLC

(57) ABSTRACT

A mine exploitation method based on stoping, separation and filling control is disclosed herein. The method includes deploying a gangue-less coal mining system; choosing a suitable coal and gangue separation method according to a separation requirement; choosing a suitable filling method
(Continued)

according to mine geology, production conditions and rock stratum control requirement; reversely calculating a filling rate according to gangue discharge requirement and control indexes by utilizing theoretical calculation, simulation and experiment; determining a filling process and a separation process according to the filling rate; and feeding back and adjusting the filling process and separation process parameters by monitoring filling and control effect indexes.

8 Claims, 4 Drawing Sheets

(51) Int. Cl.
*E21C 39/00* (2006.01)
*E21F 15/06* (2006.01)

(58) Field of Classification Search
USPC ..... 299/1.1, 1.2, 8, 11
See application file for complete search history.

(56) References Cited

U.S. PATENT DOCUMENTS 5,567,018 A * 10/1996 Hart ..... E21C 41/16 299/11
2007/0085409 A1* 4/2007 Drake ..... E21C 41/24 299/8
2012/0000654 A1* 1/2012 Justice ..... E21F 15/005 166/285
2012/0161493 A1* 6/2012 Junker ..... E21C 35/08 299/1.1
2019/0301283 A1* 10/2019 Zhang ..... E21F 15/00

FOREIGN PATENT DOCUMENTS

CN 106321102 1/2017
CN 106321103 A * 1/2017 ..... E21D 23/0481
CN 109209380 1/2019
RU 2396429 8/2010
RU 2472931 1/2013
WO WO-2010037491 A1 * 4/2010 ..... E21C 35/08
WO WO-2015196939 A1 * 12/2015 ..... E21C 41/16
WO WO-2017101634 A1 * 6/2017 ..... E21F 15/00

OTHER PUBLICATIONS

International Search Report and Written Opinion for PCT Application PCT/CN2019/080777 dated May 31, 2019.

* cited by examiner

MINE EXPLOITATION BASED ON STOPING, SEPARATION AND FILLING CONTROL

CROSS-REFERENCE TO RELATED APPLICATIONS

This U.S. application a 371 U.S. National Phase of PCT International Application No. PCT/CN2019/080777, filed on Apr. 1, 2019, which claims benefit and priority to Chinese Application No. 201811157747.2 filed on Sep. 30, 2018, both of the above-referenced applications are incorporated by reference herein in their entireties.

FIELD OF THE INVENTION

The present invention relates to a mine exploitation design method, and in particular to a mine exploitation method based on stoping, separation and filling control, which belongs to the technical field of coal mine exploitation.

DESCRIPTION OF RELATED ART

Coal always dominates in the energy system of China. However, as the amount of coal resource occupied by per capita in China is small and the amount of coal under railways, water bodies and buildings is large, the normal production of mines is continuously affected. The mass mining of coal leads to ground subsidence and ecological destruction. Moreover, with the gradual depletion of coal resource and the gradual deepening of coal mining, mine disasters have become more and more frequent as well. For example, with the increase in mining depth, the probability of the occurrence of rock bursts is also increased, and therefore the safe and green exploitation of mines has become the focus of research at present.

In recent years, with the development of solid material filling technology, such as coal gangue, relatively mature filling mining technology and equipment have been integrated and innovated to solve the problem of ground subsidence by reducing rock stratum subsidence through filling; realize aquifer protective mining by filling and controlling the development range of a water flowing fractured zone; and relieve rock burst risk by reducing the internal strain energy of coal and surrounding rock through filling. However, such a mine exploitation method aimed at a certain mine engineering requirement can mostly only be applied to a certain working face of a certain mine, and does not form a systematic, comprehensive mining method, and therefore the mine exploitation method cannot be easily matched and integrated with the original production system of the mine and also makes against engineering application and popularization.

SUMMARY OF THE INVENTION

In order to overcome the various defects existing in the prior art, the present invention provides a mine exploitation method based on stoping, separation and filling control, which can be used as a systematic process to guide the underground mining process of a coal mine so as to realize the zero discharge of coal gangue on the ground and control ground subsidence, rock burst and aquifer stability.

In order to solve the aforementioned problems, the design process of the mine exploitation method based on stoping, separation and filling control of the present invention is as follows:

step 1: deploying a gangue-less coal mining system; underground gangue mainly includes coal gangue produced during roadway excavation and coal gangue produced from a roof, a floor and a rock interlayer sandwiched in coal seams in the process of coal mining, and the gangue-less coal mining system is deployed in a manner of controlling a shearer to perform accurate selective mining and arranging less rock roadways;

step 2: choosing a suitable coal and gangue separation method according to separation capability, precision requirement, a coal gangue grain size range, size limitation of a separation chamber, complexity of separation processes and equipment cost;

step 3: choosing a suitable filling method according to geological conditions of the coal seam, mine production capability requirement, rock stratum control requirement, supply quantity of filling materials and an economic budget;

step 4: reversely calculating filling rate control requirements of a controlled object under different engineering backgrounds according to gangue discharge requirement and theoretical calculation, numerical simulation and physical simulation of equivalent mining height, development height of a water flowing fractured zone and immediate roof deflection;

step 5: determining a filling process and a separation process according to the filling rate obtained in the previous step; and step 6: further feeding back and adjusting various filling process parameters, including tamping force, the number of times of tamping, gangue grain size grading and tamping angle, and various separation process parameters, including separable grain size and separation capability, by monitoring the mass ratio of filling to mining, roof subsidence, the development height of the water flowing fractured zone, coal and rock mass strain energy density and ground subsidence; keeping the current processes if a monitoring result is good, otherwise adjusting the filling process parameters and the separation process parameters.

Such as increasing the number of times of tamping and the magnitude of tamping force, improving the supporting strength of hydraulic supports for filling mining, and optimizing the grain size proportion of filling materials.

Further, underground coal and gangue separation methods include a moving sieve jigging method, a dense-medium shallow-slot separation method, a selective crushing method and a water-medium cyclone separation method; and when one separation method can hardly meet the mine separation requirement, a combination of a variety of coal and gangue separation methods is adopted.

While having the characteristics of high separation capability, high efficiency and simple separation equipment, the moving sieve jigging method has the defects of large separation equipment and too high lower limit of separable grain sizes;

while having the characteristics of high separation capability, high precision and wide separable grain size range, the dense-medium shallow-slot separation method occupies large land area, requires medium recovery operation, and is not suitable for the separation of fine coal slime;

although the selective crushing method is low in separation precision and high in noise, separation equipment is simple, cost is low, and the selective crushing method is suitable for the predischarge of gangue from large lump coal with low requirement for the lump coal rate; and while having the characteristics of small separation equipment size, water medium, low cost and no pollution, the water-medium cyclone separation method is low in the upper limit of applicable grain sizes and not suitable for the separation of large-diameter coal gangue.

Further, the gangue filling method in step 3 includes gangue-throwing filling, comprehensive mechanized dense solid filling, cemented filling and filling-coordinated caving type mixed fully-mechanized mining, and a suitable filling method is chosen according to the geological conditions of the coal seams, mine production requirement, the goal of filling mining and the supply of filling materials.

While having the characteristics of simple equipment and little capital investment, gangue-throwing filling is low in filling capability and poor in rock stratum control effect;

while having the characteristics of good rock stratum control effect and high efficiency, comprehensive mechanized dense solid filling is not suitable for down-dip mining;

while having the characteristics of good rock stratum control effect, good adaptability to geological conditions and suitability for an area with different mining face lengths, cemented filling requires the filling material to be coagulated and pumped via a material pipeline, the production of filling mining is limited by excavation speed and pumping capability, and the process is complex; and while having the characteristic of high coal production, filling-coordinated caving type mixed fully-mechanized mining is poor in caved section rock stratum control effect, and is mostly used for the underground treatment of gangue.

Further, in step 4, the method for solving filling rates under different control requirements is as follows:

(a) when the controlled object is to control ground subsidence, the process of the filling rate solving method is as follows: analysis of ground subsidence control requirement, collection of mine geology, prediction of ground subsidence consequences under different filling rates based on a probability integration method corrected by the equivalent mining height principle, numerical simulation software, physical analog simulation or mechanical calculation method, and reverse calculation of a filling rate value according to the ground subsidence control requirement;

(b) when the controlled object is to control rock burst, the process of the filling rate solving method is as follows: analysis of the influence of a filling rate on the deflection, fracture distance and strain energy density of a roof ahead of a working face by a mechanical analysis, physical analog simulation or numerical simulation method, obtainment of a critical filling rate capable of significantly reducing the intensity of rock burst and a critical filling rate capable of preventing the roof from being fractured, and determination of a filling rate in comprehensive consideration of filling efficiency and control effect; and (c) when the controlled object is to control am aquifer, the process of the filling rate solving method is as follows: determination of a maximum water flowing fractured zone development range allowed to be produced, creation of a filling mining numerical simulation model, a mechanical model or a physical analog simulation model according to collected mine data, analysis of water flowing fractured zone development situation under different filling rates, and obtainment of a water flowing fractured zone development range relation and the filling rate.

In step 5, as the filling rate is mainly affected by the number of times of tamping, the tamping angle, the natural repose angle of a filling body, the magnitude of tamping force and the discharge height, optimal filling process parameters need to be determined in combination with the actual conditions of the mine.

The value ranges of the filling process parameters are as follows: the number of times of tamping is two to six, and when the filling rate is high, a high value is chosen; the value range of the tamping angle is determined by specific support parameters; the natural repose angle of the filling body is 34° to 60°, and is determined by the filling material; the tamping force is 2 MPa to 4 MPa, and when the filling rate is high, a high value is chosen; a discharge height is equal to (coal mining height−bottom dumping type scraper conveyer suspension height)×pilling coefficient, wherein, the mining height and the bottom dumping type scraper conveyer suspension height are determined by specific mine conditions and specific equipment size, and the value range of the pilling coefficient is 0.6 to 0.9.

The present invention is designed aimed at different control requirements of controlled objects under different engineering backgrounds, filling rate control requirements are reversely calculated, different filling processes and separation processes are then determined according to filling rates, and by coordinatively controlling stoping, underground coal and gangue separation and filling processes, th control on ground subsidence, rock bursts and aquifers can be realized. By systematically analyzing and choosing underground mining methods under different engineering backgrounds, the method enriches the connotation of the "stoping, separation and filling" integrated mining system, can realize the underground treatment of gangue and the zero discharge of gangue on the ground, solves the problem of gangue lifting and ground piling, and provides a new approach to the subsidence-reducing mining of coal resource, the prevention and control of rock bursts and the control of aquifer stability, thus having a good popularization prospect.

Figure 3:
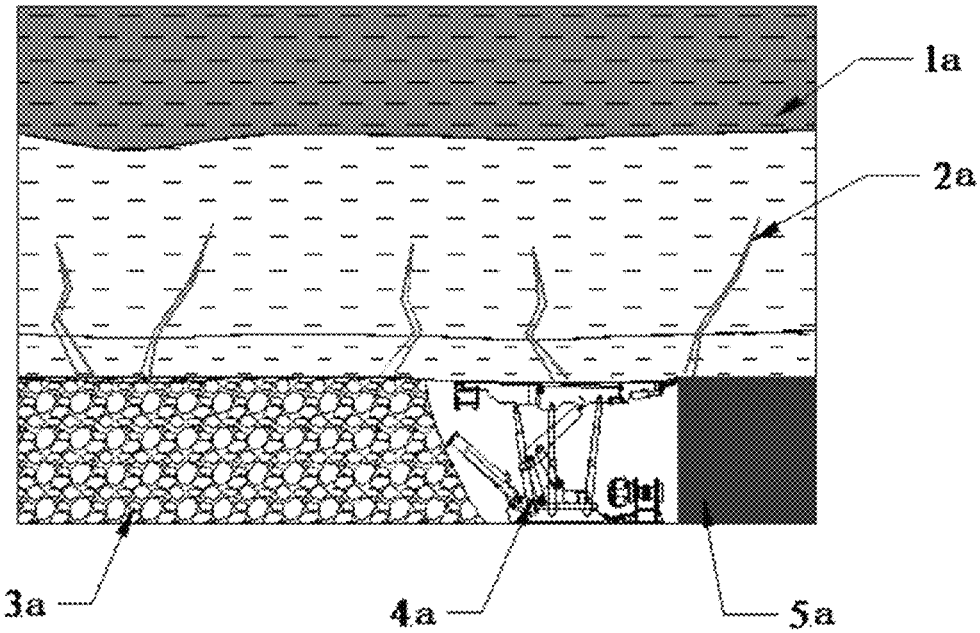
FIG. 3 is a technical schematic diagram of aquifer protective mining realized by stoping, separation and filling control.

The meanings of numerals in the aforementioned drawings are as follows:

In FIG. 3, 1*a* represents aquifer; 2*a* represents water flowing fractured zone; 3*a* represents filling area; 4*a* represents filling mining equipment a; 5*a* represents solid coal a.

Figure 4:
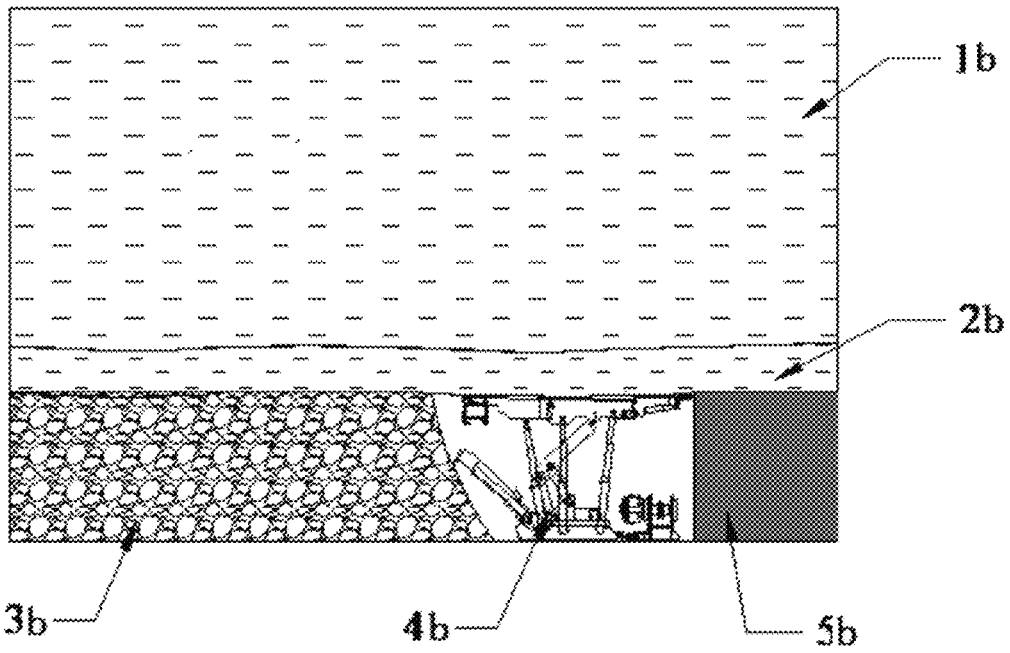
FIG. 4 is a technical schematic diagram of ground subsidence-reducing mining realized by stoping, separation and filling control.

In FIG. 4, 1*b* represents rock burst tendency type roof; 2*b* represents immediate roof; 3*b* represents filling area b; 4*b* represents filling mining equipment b; 5*b* represents solid coal b.

Figure 5:
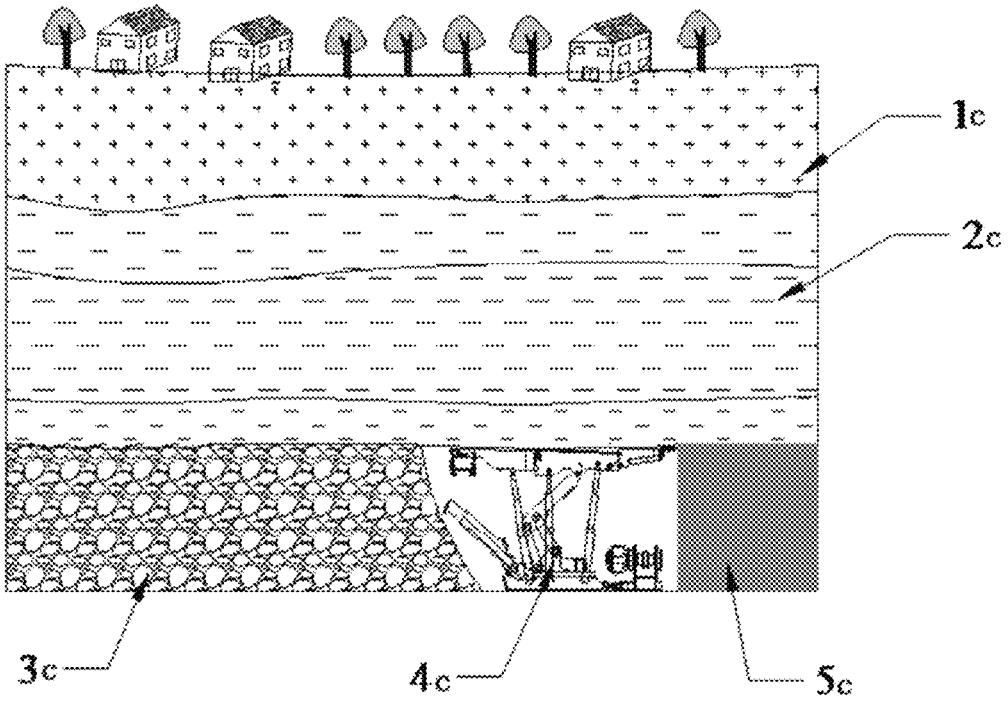
FIG. 5 is a technical schematic diagram of rock burst prevention and control realized by stoping, separation and filling control.

In FIG. 5, 1*c* represents surface soil layer; 2*c* represents overlying rock stratum of filling mining site; 3*c* represents filling area c; 4*c* represents filling mining equipment c; 5*c* represents solid coal c.

DETAILED DESCRIPTION OF THE INVENTION

The present invention is further described in detail hereinafter in reference to the drawings and specific embodiments.

Engineering background: the annual coal production of one mine is three million tons, the current main workable coal seam is coal seam No. 3, the coal body is black and of a strip-shaped structure, mudstone which is 0.5 m thick is sandwiched in the middle, the thickness of the coal seam is 3.2 m to 3.5 m, and 3.4 m on average, the inclination angle of the coal seam is 1° to 14°, and 5° on average, the reserves of the working face is stable, the coefficient of variation is 0.08%, and the index of workability is 1.0. The volume weight of the coal is 1.46 t/m3, and the protodyakonov scale of hardness of coal quality is 1 to 2. Wherein, a layer of sandstone aquifer with sufficient water exists 20 m over the working face CT1121.

Figure 1:
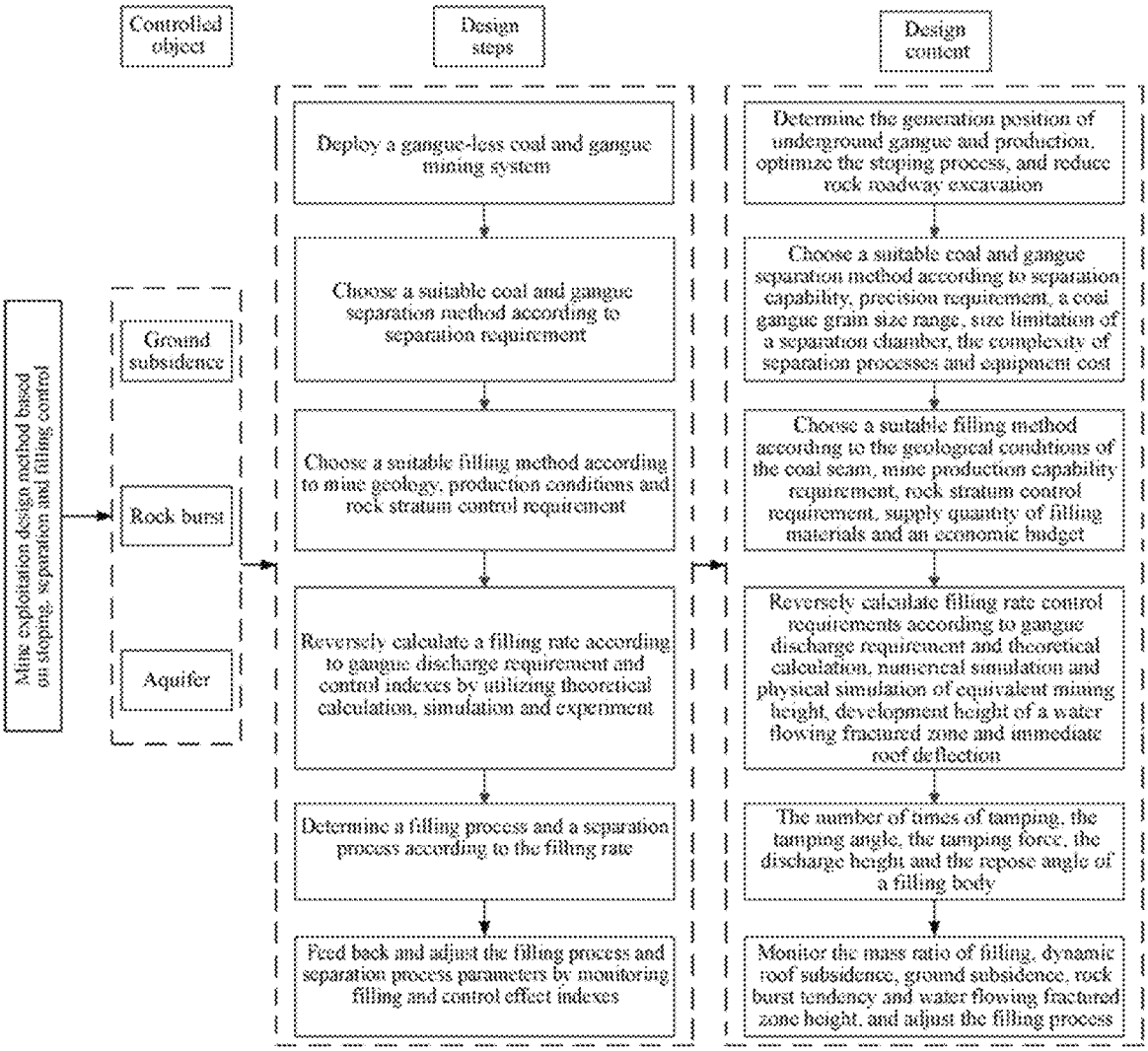
FIG. 1 is a flow chart of a mine exploitation method based on stoping, separation and filling control.
Figure 2:
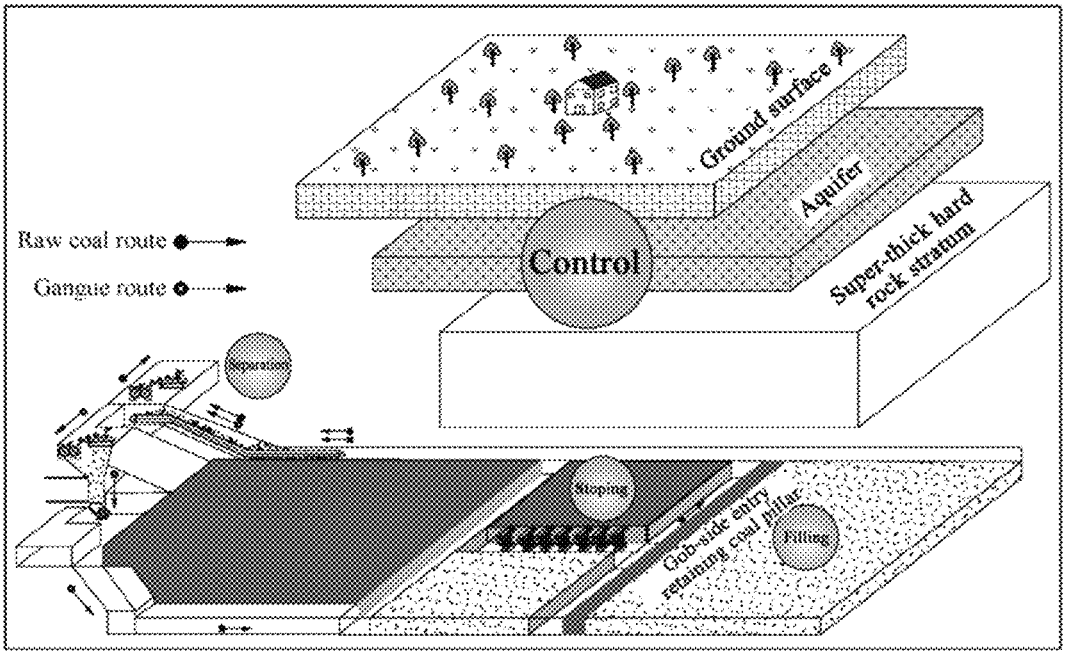
FIG. 2 is a schematic diagram of a mine exploitation method based on stoping, separation and filling control.

As shown in FIG. 1 and FIG. 2, the design process of a mine exploitation method based on stoping, separation and filling control is as follows:

step 1: a gangue-less coal mining system was deployed; underground gangue mainly includes coal gangue produced during roadway excavation and coal gangue produced from roofs, floors and rock interlayers sandwiched in coal seams in the process of coal mining, and the gangue-less coal mining system was deployed in a manner of controlling a shearer to perform accurate elective mining and arranging less rock roadways. It can be known from the conditions of the engineering background in the present embodiment that the working face CT1121 is mined under the aquifer 1*a*, and the distance is relatively close, because the conventional caving mining method can easily break through the aquifer, filling mining is chosen, as shown in FIG. 3. It is determined by investigation that the gangue source of the mine is mainly excavation gangue and gangue sandwiched in the coal seam mined from other working faces, the annual gangue production is five hundred thousand tons, and the maximum grain size of gangue-containing raw coal in the excavation of coal and rock roadways and the stoping of the working face is about 200 mm to 250 mm; by upgrading a shearer, the gangue content in raw coal is increased, moreover, by arranging more coal roadways, the production of excavation gangue is reduced, and ultimately, the annual gangue production is controlled at four hundred thousand tons.

step 2: a suitable coal and gangue separation method was chosen according to separation capability, precision requirement, a coal gangue grain size range, the size limitation of a separation chamber, the complexity of separation processes and equipment cost;

underground coal and gangue separation methods include a moving sieve jigging method, a dense-medium shallow-slot separation method, a selective crushing method and a water-medium cyclone separation method; and when one separation method can hardly meet the mine separation requirement, a combination of a variety of coal and gangue separation methods is adopted.

While having the characteristics of high separation capability, high efficiency and simple separation equipment, the moving sieve jigging method has the defects of large separation equipment and too high lower limit of separable grain sizes;

while having the characteristics of high separation capability, high precision and wide separable grain size range, the dense-medium shallow-slot separation method occupies large land area, requires medium recovery operation, and is not suitable for the separation of fine coal slime;

although the selective crushing method is low in separation precision and high in noise, separation equipment is simple, cost is low, and the selective crushing method is suitable for the predischarge of gangue from large lump coal with low requirement for the lump coal rate; and while having the characteristics of small equipment size, water medium, low cost and no pollution, the water-medium cyclone separation method is low in the upper limit of applicable grain sizes and not suitable for the separation of large-diameter coal gangue.

In the present embodiment, considering that the maximum grain size of coal gangue is relatively large, the moving sieve jigging separation method with a large upper charging limit is chosen, and moreover, because the hardness of the coal seam is low and the powdered coal content is high, a water-medium cyclone is chosen to further treat coarse slime separated by moving sieve jigging; and as the separation of small-grain size coal gangue affects the efficiency of separation, the mine reduces the production of powdered coal by decreasing the rotational speed of a drum of the shearer on the working face with gangue source and increasing the hauling speed of the shearer, so as to increase the efficiency of coal and gangue separation.

Step 3: a suitable filling method was chosen according to the geological conditions of the coal seam, mine production capability requirement, rock stratum control requirement, the supply quantity of filling materials and an economic budget;

the gangue filling method includes gangue-throwing filling, comprehensive mechanized dense solid filling, cemented filling and filling-coordinated caving type mixed fully-mechanized mining, and a suitable filling method is chosen according to the geological conditions of the coal seam, mine production requirement, the goal of filling mining and the supply of filling materials.

While having the characteristics of simple equipment and little capital investment, gangue-throwing filling is low in filling capability and poor in rock stratum control effect;

while having the characteristics of good rock stratum control effect and high efficiency, comprehensive mechanized dense solid filling is not suitable for down-dip mining;

while having the characteristics of good rock stratum control effect, good adaptability to geological conditions and suitability for an area with different mining face lengths, cemented filling requires the filling material to be coagulated and pumped via a material pipeline, the production of filling mining is limited by excavation speed and pumping capability, and the process is complex; and while having the characteristic of high coal production, filling-coordinated caving type mixed fully-mechanized mining is poor in caved section rock stratum control effect, and is mostly used for the underground treatment of gangue.

Considering that the production of the mine in the present embodiment is high, the distance between the aquifer and the mined coal seam is short, and the reserves condition of the coal seam is simple and stable, the comprehensive mechanized dense solid filling method with high filling efficiency and good rock stratum control effect is chosen.

Step 4: filling rate control requirements of controlled objects under different engineering backgrounds were reversely calculated according to gangue discharge requirement and the theoretical calculation, numerical simulation and physical simulation of equivalent mining height, development height of a water flowing fractured zone and immediate roof deflection;

the method for solving filling rates under different control requirements is as follows:

as shown in FIG. 4, (a) when the controlled object is to control ground subsidence, the upper end of an immediate roof 2*b* of the mining area is a rock burst tendency type roof 1*b*, and the process of the filling rate solving method is as follows: analysis of ground subsidence control requirement, collection of mine geology, prediction of ground subsidence consequences under different filling rates based on a probability integration method corrected by the equivalent mining height principle, numerical simulation software, physical analog simulation or mechanical calculation method, and reverse calculation of a filling rate value according to the ground subsidence control requirement;

as shown in FIG. 5, (b) when the controlled object is to control rock burst, a plurality of buildings exists at the upper end of a surface soil layer 1*c*, an overlying rock stratum 2*c* of a filling mining site exists at the lower end of the surface soil layer and the upper end of a filling mining area, and the process of the filling rate solving method is as follows: analysis of the influence of a filling rate on the deflection, fracture distance and strain energy density of a roof ahead of a working face by a mechanical analysis, physical analog simulation or numerical simulation method, obtainment of a critical filling rate capable of significantly reducing the intensity of rock burst and a critical filling rate capable of preventing the roof from being fractured, and determination of a filling rate in comprehensive consideration of filling efficiency and control effect; and as shown in FIG. 3, (c) when the controlled object is to control an aquifer, the upper end of an immediate roof of a filling gob is an aquifer 1*a*, and during mining, a plurality of water flowing fractured zones 2*a* is produced in the roof; and the process of the filling rate solving method is as follows: determination of a maximum water flowing fractured zone development range allowed to be produced, creation of a filling mining numerical simulation model, a mechanical model or a physical analog simulation model according to collected mine data, analysis of water flowing fractured zone development situation under different filling rates, and obtainment of a water flowing fractured zone development range relation and the filling rate.

In the present embodiment, the controlled object in mining is to control the aquifer, it is obtained by UDEC numerical simulation software that the aquifer at the upper part of the working face should be prevented from being destroyed, the filling rate should be higher than 85%, and in order to guarantee safety, the designed filling rate is 87%. The working face length of the working face CT1121 of filling mining is determined as 60 m according to the geological conditions of the position of the working face and the technical conditions for mining.

Step 5: a filling process and a separation process were determined according to the filling rate obtained in the previous step;

as the filling rate is mainly affected by the number of times of tamping, the tamping angle, the natural repose angle of a filling body, the magnitude of tamping force and the discharge height, optimal filling process parameters need to be determined in combination with the actual conditions of the mine.

The value ranges of the filling process parameters are as follows: the number of times of tamping is two to six, and when the filling rate is high, a higher value is chosen; the value range of the tamping angle is determined by specific support parameters; the natural repose angle of the filling body is 34° to 60°, and is determined by the filling material; the tamping force is 2 MPa to 4 MPa, and when the filling rate is high, a high value is chosen; the discharge height is equal to (coal mining height−bottom dumping type scraper conveyer suspension height)×pilling coefficient, wherein, the mining height and the bottom dumping type scraper conveyer suspension height are determined by specific mine conditions and specific equipment size, and the value range of the pilling coefficient is 0.6 to 0.9.

In the present embodiment, a filling ming model is created by SolidWorks, simulation is performed, thus obtaining tamping process parameters under the filling rate of 87%, that is, the number of times of tamping is four, the tamping angle is 20° to 65°, the magnitude of tamping force is 2 MPa, the filling space is 0.6 m, and the piling height is 2.8 m.

Step 6: various filling process parameters, including the tamping force, the number of times of tamping, gangue grain size grading and the tamping angle, and various separation process parameters, including separable grain size and separation capability, were further fed back and adjusted by monitoring the mass ratio of filling to mining, roof subsidence, the development height of the water flowing fractured zone, coal and rock mass strain energy density and ground subsidence; the current processes are kept if a monitoring result is good, otherwise the filling process parameters and the separation process parameters are adjusted.

Such as increasing the number of times of tamping and the magnitude of tamping force, improving the supporting strength of hydraulic supports for filling mining, and optimizing the grain size proportion of filling materials.

In the present embodiment, a belt weigher and a roof dynamic monitor are arranged to monitor the filling rate, moreover, a drilling method is utilized to monitor the development height of the water flowing fractured zone, monitoring results indicate that the control effect is good, and therefore, the existing processes are kept for continue mining.

What is claimed is:

1. A method of exploiting a mine, comprising:

step 1: mining, using a shearer of a gangue-less coal mining system, along an edge of a coal seam to reduce gangue generated during mining in a working face, and excavating more coal roadways than rock roadways in number to reduce an output of gangue;

step 2: choosing a coal and gangue separation method according to a sorting capacity of the mine, precision requirement, a coal gangue grain size range, size limitation of a separation chamber, complexity of separation processes and equipment cost;

step 3: choosing a filling method according to geological conditions of the coal seam, mine production capability requirement, rock stratum control requirement, supply quantity of filling materials and an economic budget;

step 4: calculating filling rate control requirements according to gangue discharge requirement and theoretical calculation, numerical simulation and physical simulation of equivalent mining height, height of a water flowing fractured zone to be reached and immediate roof deflection, wherein a belt weigher and a roof dynamic monitor are arranged to monitor a filling rate;

step 5: determining a filling process and a separation process according to the filling rate control requirements obtained in the step 4; and step 6: further feeding back and adjusting filling process parameters and separation process parameters, the filling process parameters comprising tamping force, the number of times of tamping, gangue grain size grading and tamping angle, and the separation process parameters comprising separable grain size, by monitoring a mass ratio of filling to mining, roof subsidence, a height of mining induced water-conducting fissures, coal and rock mass strain energy density and ground subsidence; adjusting the filling process parameters and the separation process parameters as determined by monitoring the filling rate via the belt weigher and the roof dynamic monitor.

2. The mine exploitation method according to claim 1, wherein, an underground coal and gangue separation method comprises a moving sieve jigging method, a water-medium cyclone separation method, and any combination thereof.

3. The mine exploitation method according to claim 2, wherein, the gangue filling method in the step 3 comprises gangue-throwing filling, mechanized dense solid filling, cemented filling, and filling-coordinated caving type mixed fully-mechanized mining.

4. The mine exploitation method according to claim 3, wherein, the value ranges of the filling process parameters are as follows: the number of times of tamping is two to six, and when the filling rate is high, a higher than 85%, a value higher than 3 is chosen; the natural repose angle of a filling body is 34° to 60°, and is determined by the filling material; the tamping force is 2 MPa to 4 MPa, and when the filling rate is higher than 85% a value higher than 3 is chosen; a discharge height is expressed as: (coal mining height−bottom dumping type scraper conveyer suspension height)× pilling coefficient, wherein, the mining height and the bottom dumping type scraper conveyer suspension height are determined by specific mine conditions and specific equipment size, and the value range of the pilling coefficient is 0.6 to 0.9.

5. The mine exploitation method according to claim 2, wherein, the value ranges of the filling process parameters are as follows: the number of times of tamping is two to six, and when the filling rate is high, a higher than 85%, a value higher than 3 is chosen; the natural repose angle of a filling body is 34° to 60°, and is determined by the filling material; the tamping force is 2 MPa to 4 MPa, and when the filling rate is higher than 85% a value higher than 3 is chosen; a discharge height is expressed as: (coal mining height−bottom dumping type scraper conveyer suspension height)× pilling coefficient, wherein, the mining height and the bottom dumping type scraper conveyer suspension height are determined by specific mine conditions and specific equipment size, and the value range of the pilling coefficient is 0.6 to 0.9.

6. The mine exploitation method according to claim 1, wherein:

(a) when ground subsidence is to be controlled, the step 4 further comprises: analysis of ground subsidence control requirement, collection of mine geology, prediction of ground subsidence consequences under different filling rates, and reverse calculation of a filling rate value according to the ground subsidence control requirement;

(b) when rock burst is to be controlled, the step 4 further comprises: analysis of the influence of a filling rate on the deflection, fracture distance and strain energy density of a roof ahead of a working face by a mechanical analysis, physical analog simulation or numerical simulation method, obtainment of a critical filling rate capable of reducing the intensity of rock burst and a critical filling rate capable of preventing the roof from being fractured, and determination of a filling rate in consideration of filling efficiency and control effect; and (c) when an aquifer is to be controlled, the step 4 further comprises: determination of a maximum height of mining induced water-conducting fissures allowed to be produced, creation of a filling mining numerical simulation model, a mechanical model or a physical analog simulation model according to collected mine data, analysis of the height of mining induced water-conducting fissures under different filling rates, and obtainment of the height of mining induced water-conducting fissures and the filling rate.

7. The mine exploitation method according to claim 6, wherein, the value ranges of the filling process parameters are as follows: the number of times of tamping is two to six, and when the filling rate is high, a higher than 85%, a value higher than 3 is chosen; the natural repose angle of a filling body is 34° to 60°, and is determined by the filling material; the tamping force is 2 MPa to 4 MPa, and when the filling rate is higher than 85% a value higher than 3 is chosen; a discharge height is expressed as: (coal mining height−bottom dumping type scraper conveyer suspension height)× pilling coefficient, wherein, the mining height and the bottom dumping type scraper conveyer suspension height are determined by specific mine conditions and specific equipment size, and the value range of the pilling coefficient is 0.6 to 0.9.

8. The mine exploitation method according to claim 1, wherein, the value ranges of the filling process parameters are as follows: the number of times of tamping is two to six, and when the filling rate is higher than 85%, a value higher than 3 is chosen; the natural repose angle of a filling body is 34° to 60°, and is determined by the filling material; the tamping force is 2 MPa to 4 MPa, and when the filling rate is higher than 85% a value higher than 3 is chosen; a discharge height is expressed as: (coal mining height−bottom dumping type scraper conveyer suspension height)× pilling coefficient, wherein, the mining height and the bottom dumping type scraper conveyer suspension height are determined by specific mine conditions and specific equipment size, and the value range of the pilling coefficient is 0.6 to 0.9.

* * * * *